US005953564A

United States Patent [19]

Matsuzoe et al.

[11] Patent Number: 5,953,564

[45] Date of Patent: Sep. 14, 1999

[54] IMAGE DISPLAY UNIT HAVING TRANSFER BELT AND ORTHOGONALLY TENSIONED CARRIER

[75] Inventors: Hisanobu Matsuzoe, Chikushino; Kouji Migita; Yukinori Hara, both of Fukuoka-ken, all of Japan

[73] Assignee: Matsushita Electric Industrial Co., Ltd., Osaka, Japan

[21] Appl. No.: 09/145,253

[22] Filed: Sep. 2, 1998

[30] Foreign Application Priority Data

Sep. 19, 1997 [JP] Japan ..... 9-254512

[51] Int. Cl.[6] ..... G03G 15/00; G03G 15/16

[52] U.S. Cl. ..... 399/158; 399/297

[58] Field of Search ..... 399/144, 302, 399/308, 158, 297

[56] References Cited

U.S. PATENT DOCUMENTS 5,065,187 11/1991 Itoh et al. ..... 399/158 X
5,172,164 12/1992 Fujiwara et al. ..... 399/158 X
5,309,203 5/1994 Hokari ..... 399/308 X
5,499,092 3/1996 Sasaki ..... 399/302
5,587,779 12/1996 Heeren et al. ..... 399/308

FOREIGN PATENT DOCUMENTS 8-82969 3/1996 Japan .

*Primary Examiner*—Susan S. Y. Lee
*Attorney, Agent, or Firm*—Stevens, Davis, Miller & Mosher, L.L.P.

[57] ABSTRACT

An image display unit including an endless transfer belt that is tensioned by a plurality of rollers. A toner image carrier is tensioned in a direction orthogonal to the rotational direction of the transfer belt. An image formation system provides a toner image carrier with a toner image. A transfer roller disposed inside the toner image carrier permits transfer of the toner image to the transfer belt by orthogonal rotation as compared to the rotational direction of the transfer belt. The transferred image is displayed, then erased by a cleaning blade.

12 Claims, 12 Drawing Sheets

IMAGE DISPLAY UNIT HAVING TRANSFER BELT AND ORTHOGONALLY TENSIONED CARRIER

BACKGROUND OF THE INVENTION (i) Field of the Invention

The present invention relates to an image display unit using a crossflow image transfer system, which transfers a toner image on an image transfer belt and displays the image transferred thereon.

(ii) Description of the Prior Art

Recently, an image formation unit using an electrophotographic system, which is so excellent in resolution as to enable providing a clear image, have been remarkably improved in its performance, as represented by a laser printer. Further, as a practical application of the image formation unit, an image display unit for a guide bulletin board or poster display board also has been popularized.

Hereinafter, such an image display unit is explained.

FIG. 14 is a schematic side view illustrating an conventional image display unit, and FIG. 15 is a perspective view showing the image transferring steps in the conventional image display unit. FIG. 16 is a perspective view representing a state of a displayed image in the conventional display unit, and FIG. 17 is a typical schematic view illustrating a formation of a toner layer on an image developing roller in the conventional image formation unit.

In FIGS. 14 to 16, the constitution of the image display unit is generally separated into a toner image formation unit 1 and a transfer belt 2 serving as a display board.

The toner image formation unit 1 comprises a toner image carrier 3 of a photosensitive material drum whose surface is coated with a layer of an organic photo-conductive material and devices for forming a toner image on the toner image carrier 3. The items of the devices are a charging means 4, developing means 5, cleaning means 6 and discharging means 7, etc. each of which is positioned around the toner image carrier 3, and an exposing means 8 for radiating a laser beam which is disposed under the toner image carrier 3. The toner image carrier 3 is rotated counterclockwise so that the image thereon is continuously formed on the transfer belt 2, and the transfer belt 2 displays the complete image on one of its own surfaces opposite to the toner image formation unit 1 to thereby serve as a so-called display means.

A successive flow of the image formation steps is explained below.

In FIGS. 14 to 16, the charging means 4 charges uniformly the surface of the toner image carrier 3 passed by to around minus 600 V. The exposing means 8 formed of optical system devices such as a laser radiator, polygon mirror, etc. radiates a laser beam based upon a supplied image signal thereto and thereby raises a surface voltage of the exposed portion in the toner image carrier 3 to around minus 100 V to provide resultingly the surface of the toner image carrier 3 with an electrostatic latent image. The developing means 5 forms the toner image on the toner image carrier 3 so as to change the electrostatic latent image into a visible image, by pushing a developing roller 10 to which a negatively charged toner 9 has adhered against the toner image carrier 3 and thus transferring the toner 9 to the electrostatic latent image on the surface of the toner image carrier 3. As illustrated in FIG. 17, the width of a monochromatic toner layer 11 such as a black layer etc. is prevented from extending beyond the width of the toner image carrier 3 by sealing both the side ends of the width of the layer 11 with sealing members 11. A transferring means 14 applies a positive voltage to the transfer belt 2 from the back thereof in order to transfer the toner image on the surface of the toner image carrier 3 onto the transfer belt 2 to thereby pull and separate the negatively charged toner image from the surface of the toner image carrier 3, and resultingly transfers continuously the toner image to the transfer belt 2.

After the transfer onto the transfer belt 2 is completed, the cleaning means 6 removes and recovers residual toner on the surface of the toner image carrier 3 by means of a cleaning blade or cleaning brush to thus clean the surface of the toner image carrier 3 physically. The recovered toner is conveyed toward the developing means 5 by a toner conveying means 15 (as denoted by an arrow of the dotted line in FIG. 14) and reclaimed as a toner material. Since the transfer efficiency of the toner image carrier 3 onto the transfer belt 2 is around 90 to 95% only at present, the toner material is utilized effectively by recovering and reclaiming all of the residual toner on the toner image carrier 3. The discharging means 7 neutralizes a negative charge remaining after removal of the residual toner on the surface of the toner image carrier 3 and thus cleans the surface thereof electrically.

After the image transfer is conducted, as shown by FIG. 16, the surface of the transfer belt 2, having the transferred image thereon, is moved to the position opposite to the toner image formation unit 1 and the complete image is displayed there. The transfer belt 2 is made of non-photosensitive material and corresponds to an intermediate transfer means in a present image formation device applied to a color display unit. In other words an image formation unit is defined as a unit to finally fix an image to a print paper, and an image display unit is defined as a unit to display an image and subsequently erase the image when the display ends.

When it is ended to display the image on the transfer belt 2, there the entirety of the image is erased on the transfer belt 2 (the image can be taken as a residual toner material just when the display is over) so as to prepare for the following image transfer. For this purpose, the whole of the image on the transfer belt 2 (it remains as an aggregation of the toner 9 itself because it is neither heated nor fixed) is removed and recovered by means of a cleaning blade or cleaning brush of the cleaning means 16 used exclusively for the transfer belt 2 to thus clean the surface of the toner image carrier 3. The recovered toner is conveyed toward the developing means 5 by a toner conveying means 17 (as denoted by an arrow of the dotted line in FIG. 14) and supplemented (reclaimed) as a toner material.

As mentioned above, a successive flow of the image formation steps is completed. However, in such a conventional image display unit, a rotational direction of the toner image carrier 3 is parallel to that of the transfer belt 2 and consequentially it is required that the width of the toner image carrier 3 matches with that of the transfer belt 2. Accordingly, even in the image display unit for handling a monochrome system as described above, the developing means 5 and the exposing means 8 each occupy a large space correspondingly to the widths of the toner image carrier 3 and the transfer belt 2. Especially, when there is produced a toner image formation unit designed for a colored image, a developing means is necessary for each of the four primary colors of cyan, magenta, yellow and black, and even as far as this concerned, the number of the parts increases up to four times as many as that of a monochrome system. Further, the toner image carrier is necessarily changed from the photosensitive material drum to a photosensitive material belt in order an exposing means is shared by each developing means for the four colors, accordingly the number and the sizes of the parts are inevitably increased so largely. For the above reasons, there is a problem that it is difficult to miniaturize an image display unit and reduce the number of the parts.

SUMMARY OF THE INVENTION

An object of the present invention is to provide an image display unit wherein a main body is miniaturized by utilizing a toner image carrier whose width is narrower than that of a transfer belt.

In order to achieve this object, an image display unit of the present invention comprises a transfer belt of an endless type being tensioned by a plurality of rollers, a toner image carrier of an endless type being tensioned in the direction orthogonal to the rotational direction of the transfer belt, an image formation means for providing the toner image carrier with a toner image, and a transfer handling roller disposed inside the toner image carrier for transferring the toner image held on the toner image carrier onto the transfer belt by being rotated in the direction orthogonal to the rotational direction of the transfer belt, wherein the toner image carrier is rotated in the direction orthogonal to the rotational direction of the transfer belt, and the width of the toner image carrier is not restricted by that of the transfer belt so that the former is enabled to be smaller than the latter. Accordingly the present invention has an advantage to miniaturize an image display unit sharply.

DETAILED DESCRIPTION OF THE PREFERRED EMBODIMENTS

Figure 1:
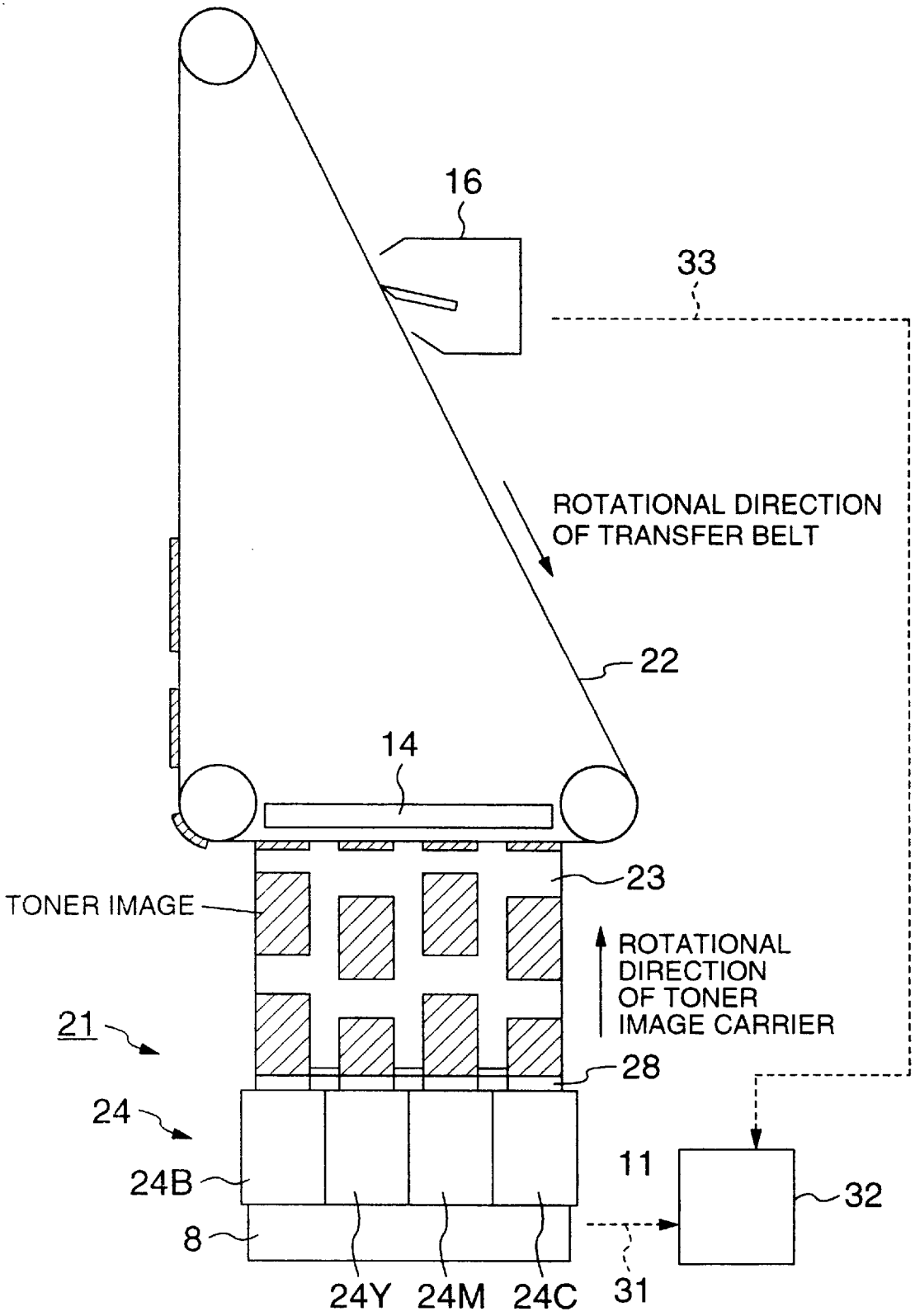
FIG. 1 is a schematic side view illustrating an image display unit according to a first embodiment of the present invention.

Referring to FIGS. 1 to 13, embodiments of the present invention are described below, the same parts in the conventional unit are denoted by the same reference numerals.

Embodiment 1

In a conventional example, a rotational direction of a toner image carrier is parallel to that of a transfer belt and hence the width of the toner image carrier matches inevitably with that of the transfer belt. On the other hand, in the summary of the first embodiment of the present invention, by changing the above, the width of a toner image carrier is enabled to be set smaller than that of a transfer belt by managing to dispose the toner image carrier in the direction orthogonal to the direction of the transfer belt, and a toner image formation unit is thereby miniaturized a great extent.

Hereinafter, referring to FIGS. 1 to 11, the first embodiment of the present invention is described in detail.

Figure 2:
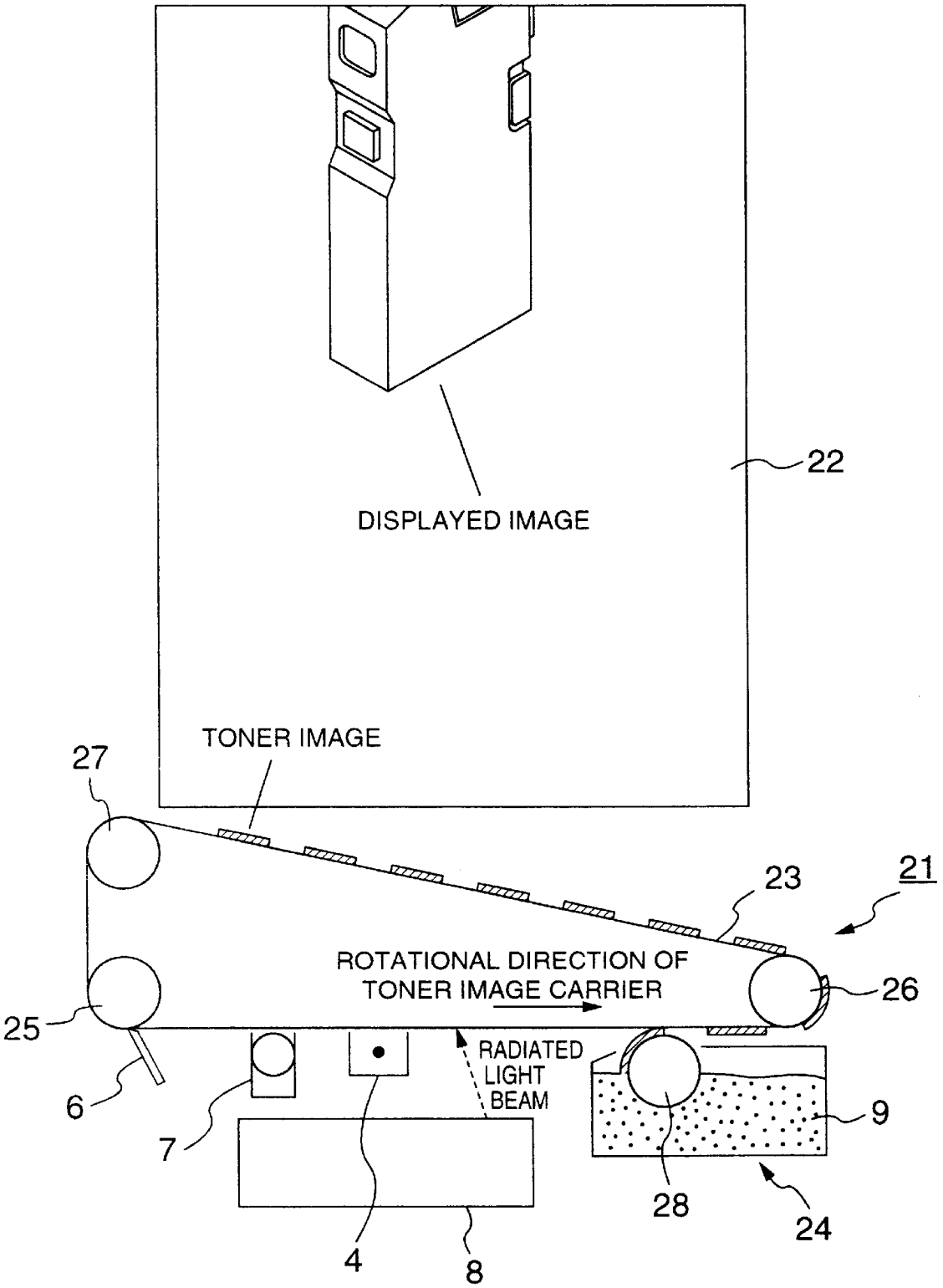
FIG. 2 is a schematic front view illustrating formation steps of an toner image in the image display unit according to the first embodiment of the present invention.
Figure 3:
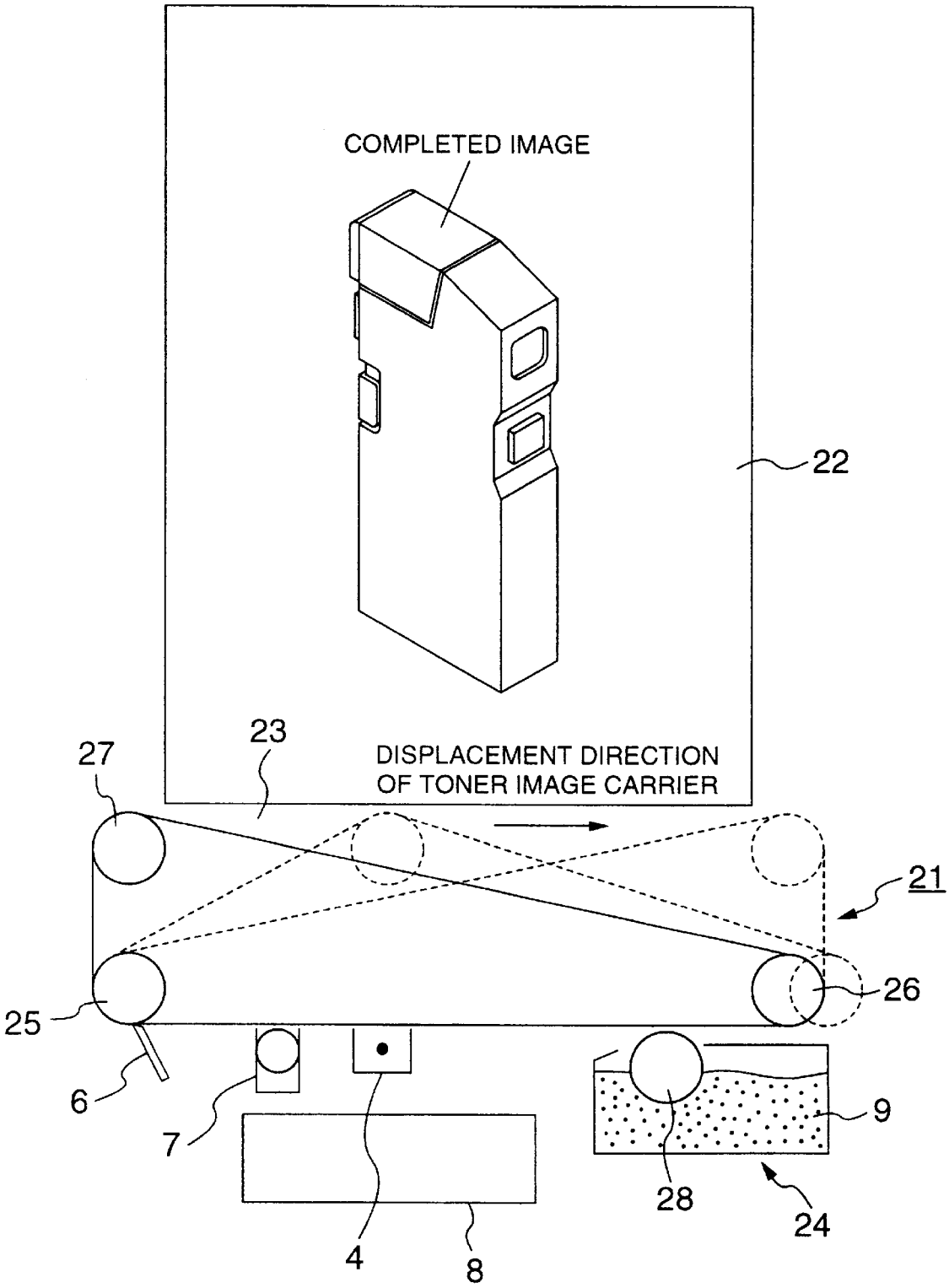
FIG. 3 is a schematic front view illustrating a state of an image transfer in the image display unit according to the first embodiment of the present invention.
Figure 4:
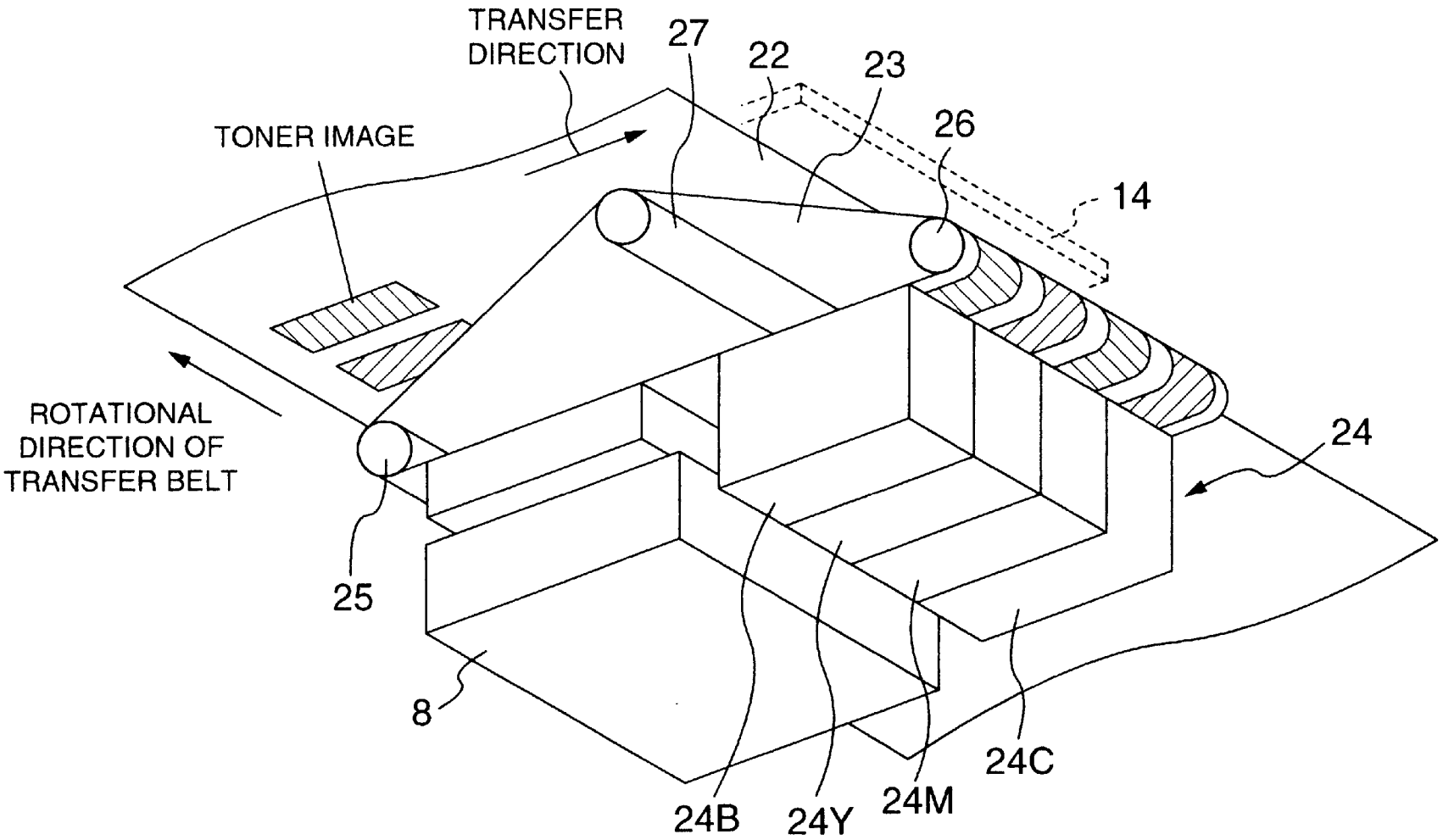
FIG. 4 is a partial perspective view illustrating a state of an image transfer in the image display unit according to the first embodiment of the present invention.
Figure 5:
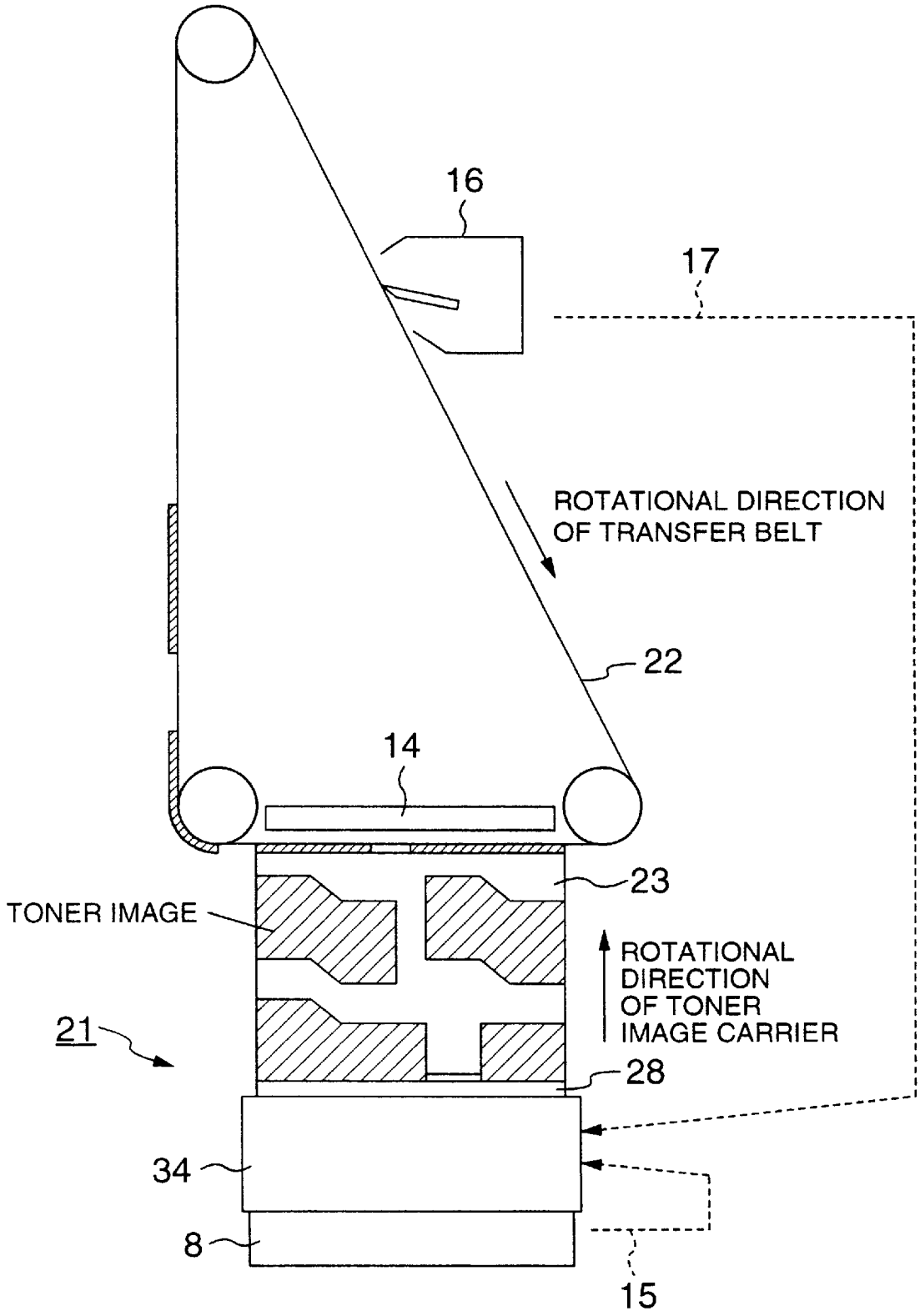
FIG. 5 is a schematic front view illustrating a toner conveying means in the image display unit according to the first embodiment of the present invention.
Figure 6:
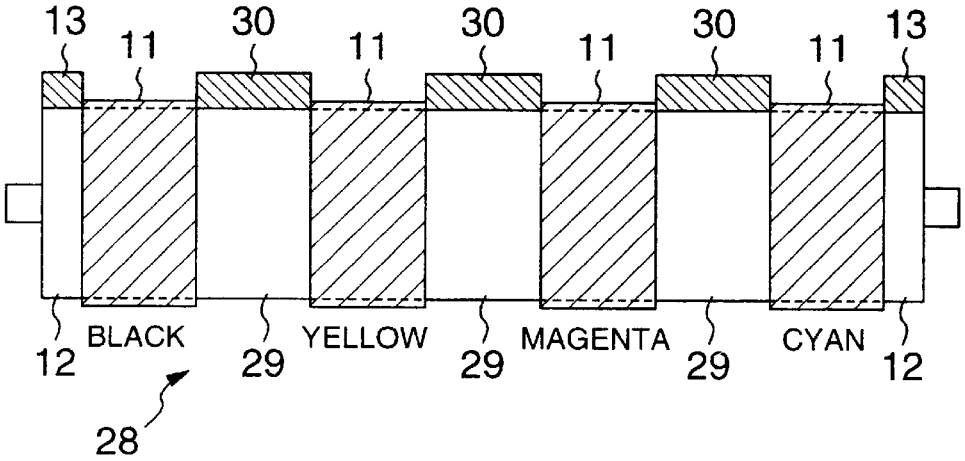
FIG. 6 is a typical schematic view illustrating a formation of a toner layer by a developing roller in the image display unit according to the first embodiment of the present invention.
Figure 7:
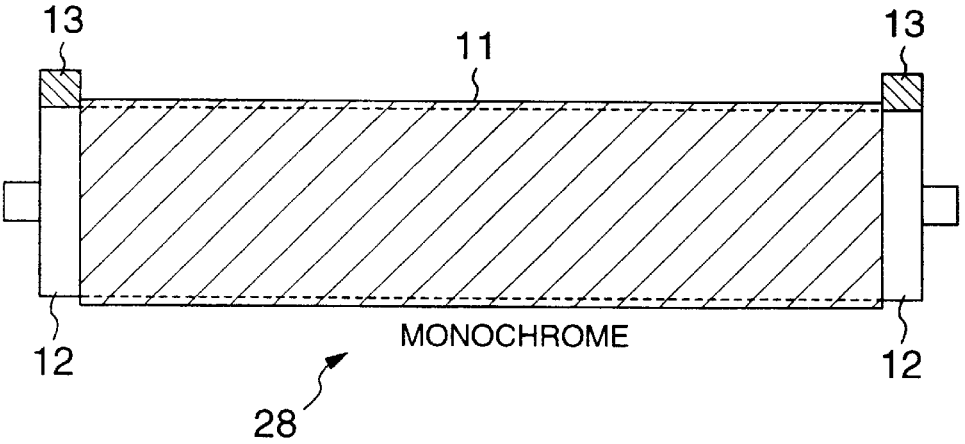
FIG. 7 is a typical schematic view illustrating a formation of a toner layer by a developing roller in the image display unit according to the first embodiment of the present invention.

FIG. 1 is a schematic side view illustrating an image display unit according to the first embodiment. FIG. 2 is a schematic front view illustrating formation steps of an toner image in the image display unit according to the first embodiment of the present invention. FIG. 3 is a schematic front view illustrating a state of an image transfer in the image display unit according to the first embodiment of the present invention. FIG. 4 is a partial perspective view illustrating a state of an image transfer in the image display unit according to the first embodiment of the present invention. FIG. 5 is a schematic front view illustrating a toner conveying means in the image display unit according to the first embodiment of the present invention. FIGS. 6 and 7 are schematic views illustrating a formation of a toner layer by a developing roller in the image display unit according to the first embodiment of the present invention and FIGS. 8 to 11 are schematic views illustrating a state of an image transfer in the image display unit according to the first embodiment of the present invention.

In FIGS. 1 to 3, the constitution of the image display unit is generally separated into a toner image formation unit 21 for forming the toner image and a transfer belt 22 for serving as a display board.

The toner image formation unit 21 is disposed under the transfer belt 22 in FIGS. 1 to 3. However, the installation position of the toner image formation unit 21 is allowed to take an upper or lower position than the transfer belt 22. If the toner image formation unit 21 is disposed under the transfer belt 22, then the more preferable results are obtained in the following two points as compared with the case than when it is disposed over the transfer belt 22. As the first point, even if a part of toner is dropped from the toner image carrier 23, the dropped toner never adheres to the transfer belt 22 positioned over the toner image carrier 23 so that a clear image is able to remain unchanged. As the second point, a surface of the transfer belt 22, having a transferred image thereon, is sagged slightly to bag outwardly due to its dead load (if the surface is positioned in an upper position, it tends to concave downward and makes it difficult to maintain the flatness of the surface.), however, the surface is supported by the toner image carrier 23 positioned under the surface so that its flatness is maintained and also both of the surface of the transfer belt 22 and the toner image carrier 23 are contacted with each other, consequently the image transfer efficiency is not reduced.

The toner image formation unit 21 is not disposed at the side surface of the transfer belt 22, being different from the conventional example, this is because a deviation of the amount of the toner 9 is caused when the direction of gravity is not perpendicular to the longitudinal direction of a developing roller 28 in a developing means 24.

Referring to FIGS. 1 to 3, the outline of the image display unit is explained as follows. The toner image formation unit 21 comprises the toner image carrier 23 having a photosensitive material belt whose surface is coated with an organic photoconductive material and devices for forming a toner image on the toner image carrier 23. The specification of the devices are a charging means 4, developing means 24, cleaning means 6, discharging means 7, etc. which are each disposed around the toner image carrier 23, and an exposing means for radiating a laser beam which is positioned under the toner image carrier 23. In the first embodiment of the present invention, a laser is used as a typical of the exposing means 8; however, an LED or LCD is usable instead of the laser. The toner image carrier 23 is tensioned in the direction orthogonal to the rotational direction of the transfer belt 23 by a plurality of rollers such as a support roller 25, displacement roller 26, transfer handling roller 27, etc. and rotated in the direction of the arrow (clockwise) at the time of an image formation to thereby form the toner image on the surface of the transfer belt 23.

The image is formed by degree on the transfer belt 22 by transferring repeatedly the toner image formed on the toner image carrier 23 onto the transfer belt 22 in a way as mentioned after, and, as shown in FIG. 3, the transfer belt 22 displays the resultingly transferred image formed on the surface opposite to the toner image formation unit 21 and hence serves as an display. A successive flow of the image formation steps is explained below.

As shown by the arrow in FIGS. 1 and 2, when the toner image carrier 23 is rotated in the direction orthogonal to the rotational direction of the transfer belt 22, a portion of the carrier 23 passed near the charging means 4 is charged uniformly to around minus 600 V. The exposing means 8 radiates each laser beam corresponding to the four primary colors respectively to one line on the surface of the development image carrier 23 based upon each image signal corresponding to the four primary colors of cyan, magenta, yellow and black respectively. The electrostatic latent image sectioned into the four parts corresponding to the four primary colors is provided at the same time on the surface of the toner image carrier 23 by raising an electric potential in a portion radiated with a laser beam up to minus 100 V. When each toner of the four primary colors is pushed by a developing roller 28 against where the electrostatic latent image is formed, each toner image of the four primary colors appears sequentially as a visual image on the toner image carrier 23.

As shown in FIGS. 1 and 4, the developing means 24 is made up of the four compartments each corresponding to the primary colors respectively, and the toner layers of the four primary colors of cyan, magenta, yellow and black are formed on the shared developing roller 28 separately and correspondingly to the primary colors respectively, by employing the primary color toners each contained in the compartments, such as a cyan toner in a developing means 24C, magenta toner in a developing means 24M, yellow toner in a developing means 24Y and black toner in a developing means 24B. As illustrated in FIG. 6, the toner layers 11 of the four colors are formed on the developing roller 28 in the order of cyan, magenta, yellow and black toners from the right side thereof, and the width of the each toner layer 11 is prevented from extending beyond the width of the toner image carrier 23 by sealing both the side end gaps 12 of the carrier 23 by use of sealing members 13. Each toner layer is separated by a gap 29 so as to avoid any color mixture, each gap 29 is sealed by a sealing material 30 and hence protected usually from any adhesion of the toner material.

FIG. 6 shows an example of the developing roller 28 handling a color development, in which example it is possible to additionally use the dilute colors of cyan and magenta in order to reproduce a photographic color tone etc. Also, as known, the black color is able to be prepared by employing the toners of the three primary colors of cyan, magenta and yellow without using a back toner. Consequently the developing means 24 can be constituted by the developing means 24C, 24M and 24Y. With respect to the developing roller 28 itself, it is possible to employ the roller, as shown in FIG. 7. When handling a monochromatic color such as a black color etc., in such case, the width of a monochromatic toner layer 11 is prevented from extending beyond the width of the toner image carrier 23 by sealing both the side end gaps 12 of the toner layer 11 by means of the sealing members 13.

On the occasion of the image transfer onto the transfer belt 22, as illustrated in FIGS. 3 and 4, the rotation of the transfer belt 22 is interrupted temporarily and stopped, and simultaneously the rotation of the toner image carrier 23 is also stopped. Subsequently, a portion provided with the toner image of the four primary colors, of the surface of the toner image carrier 23, is rubbed against the transfer belt 22 by rolling the transfer handling roller 27 from the back surface of the above portion so that the image transfer is thus conducted, and the the toner image carrier 23 is displaced from the left end to the right end, or vice versa, by a length needed for one transferring step. At this time, the surface of the toner image carrier 23, whose toner image of the four primary colors has been transferred, is detached by degree from the transfer belt 22 as the transfer handling roller 27 moves along the transfer belt 22. During the transferring step, in order to transfer the toner image on the toner image carrier 23 to the transfer belt 22, the transferring means 14 applies a positive voltage from behind the transfer belt 22, pulls and separates the negatively charged toner image from the surface of the toner image carrier 23, and thus transfers the image onto the surface of the transfer belt 22 repeatedly. The toner image carrier 23 can conduct the image transfer not only in the forward direction but also in the backward direction. At this time, when the direction that the toner image carrier 23 moves is viewed from the side of the transfer belt 22, the toner image carrier 23 is displaced on the transfer belt 22 in a direction orthogonal to the rotational direction of the transfer belt 22. It becomes first possible to set the width of the toner image carrier 23 narrower than that of the transfer belt 22 without being controlled by the width of the transfer belt 22. By employing such a constitution that the toner image carrier 23 is displaced in the rotational direction of the transfer belt 22, namely, in the direction orthogonal to the longitudinal direction of the transfer belt 22.

After the transfer to the transfer belts 22 is completed, the cleaning means 6 removes and recovers the residual toner on the surface of the toner image carrier 23 by use of a cleaning blade or cleaning brush to clean the surface of the toner image carrier 23.

The recovered residual toner is conveyed to a waste toner box 32 by a toner conveying means 31 using an auger etc. (as shown by the dotted line in FIG. 1). On the other hand, the discharging means 7 neutralizes a negative charge remaining on the surface of the toner image carrier 23 after removal of the residual toner to hence clean the surface of the toner image carrier 23 electrically.

After the image is transferred from the toner image carrier 23, the transfer belt 22 provided with the image is gradually moved to the front side of the image display unit and displays the complete image. The transfer belt 22 is made of non-photosensitive material and corresponds to an intermediate of an up-to-date image display unit handling a color display.

When the display of the image on the transfer belt 22 ens of the whole image is erased from the transfer belt 22 (the image can be regarded as a residual toner material just when the display ends) so as to prepare for the subsequent image transfer. For this purpose, the entirety of the image on the transfer belt 22 (it is an aggregation itself of a toner 9 as a mixture of the four primary color toners because it is neither heated nor fixed) is removed and recovered by means of a cleaning blade or cleaning brush of the cleaning means 16 used exclusively for the transfer belt 22 to thus clean physically the surface of the toner image carrier 23. The waste toner box 32 is illustrated in FIG. 1, the residual toner recovered from the transfer belt 22 is conveyed toward the waste toner box 32 by a toner conveying means 33 (as denoted by the arrow of the dotted line) and contained therein together with the residual toner recovered from the toner image carrier 23. In other words, in an image display unit for a color display, a recovered toner is a mixture of the toners of the four primary colors and cannot be reclaimed any more so that all the toner is abandoned. Thus, by containing the waste toner recovered by the toner image formation unit 21 and the other waste toner recovered by the transfer belt 22 together in the same waste toner box 32, a nuisance treatment of the waste toner can be conducted at once.

Toner conveying means 15 and 16 are shown in FIG. 5. In an image display unit handling a monochromatic color, for the purpose of reclaiming a recovered toner like a conventional unit, the waste toner recovered from the toner image carrier 23 and the other waste toner recovered from the transfer belt 22 are conveyed to the developing means 34 by the toner conveying means 15 and the other toner conveying means 16 respectively, and consequently the conveyed toner is reclaimed (supplied) as a toner 9. As previously referred to in the discussion of a conventional unit, a transfer efficiency of the toner image of from the toner image carrier 23 to the transfer belt 22 only is 90 to 95%. Accordingly it is very important to recover and reclaim all the residual toner on the toner image carrier 23. A successive flow of the image formation steps is thus completed.

As illustrated in FIGS. 8 to 11, there exists development zones for each color to be developed by the developing means 24 and non-development zones sandwiched between the development zones on the toner image carrier 23, the widths of the development zones in the rotational direction of the transfer belt 22 are designed to be equal to each other. In particular FIGS. 8 to 11 show that the ratio of the width of the development zone and that of the non-development zone is set to be 1 to 1. Hereinafter, how to produce a color toner image is described.

Figure 8:
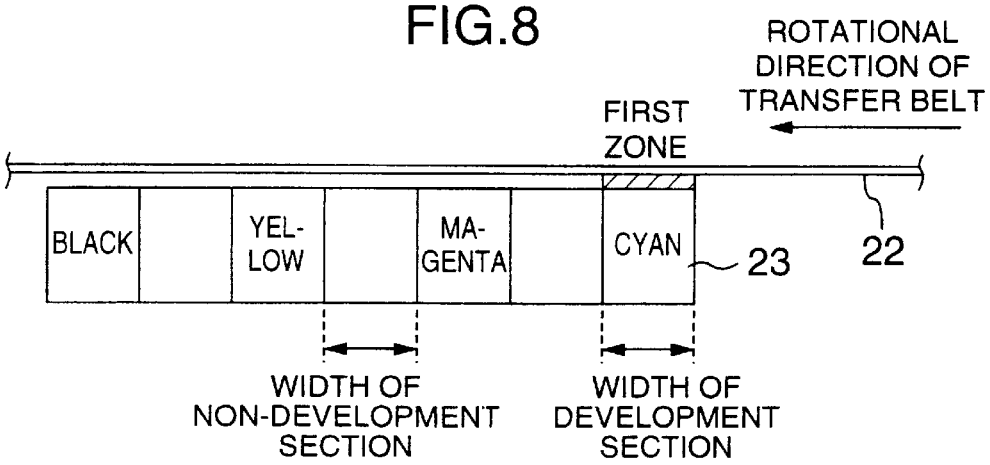
FIG. 8 is a typical schematic view illustrating a state of an image transfer in the image display unit according to the first embodiment of the present invention.

A production of the color toner image is started from the state shown in FIG. 8, in the first transfer. Only the toner image of {cyan} is transferred in one producing step to the first zone. When the transfer belt 22 is rotatably moved by a length corresponding to the width of the development zone, the second transfer is carried out in such a manner that only the toner image of {cyan} is likewise transferred in one producing step to the second zone.

Figure 9:
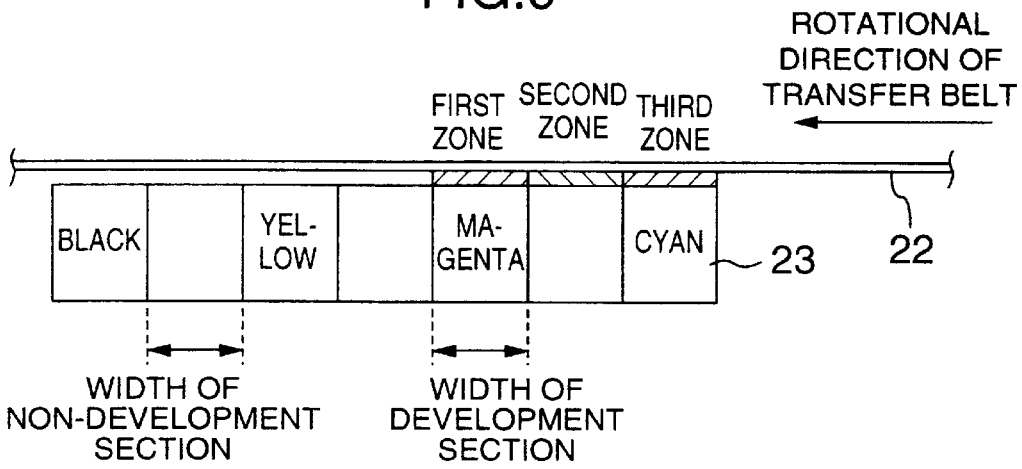
FIG. 9 is a typical schematic view illustrating a state of an image transfer in the image display unit according to the first embodiment of the present invention.

Next, as shown in FIG. 9, in the third transfer, the toner images of {cyan and magenta} are transferred in one producing step so that the superimposed toner images of {cyan and magenta} is formed on the first zone and only the toner image of {cyan} is transferred to the third zone. When the transfer belt 22 is rotatably moved by a length corresponding to the width of the development zone, likewise the fourth transfer is carried out in such a manner that the toner images of {cyan and magenta} are likewise transferred in one producing step so that the superimposed toner images of {cyan and magenta} are formed on the second zone and only the toner image of {cyan} is transferred to the fourth zone.

Figure 10:
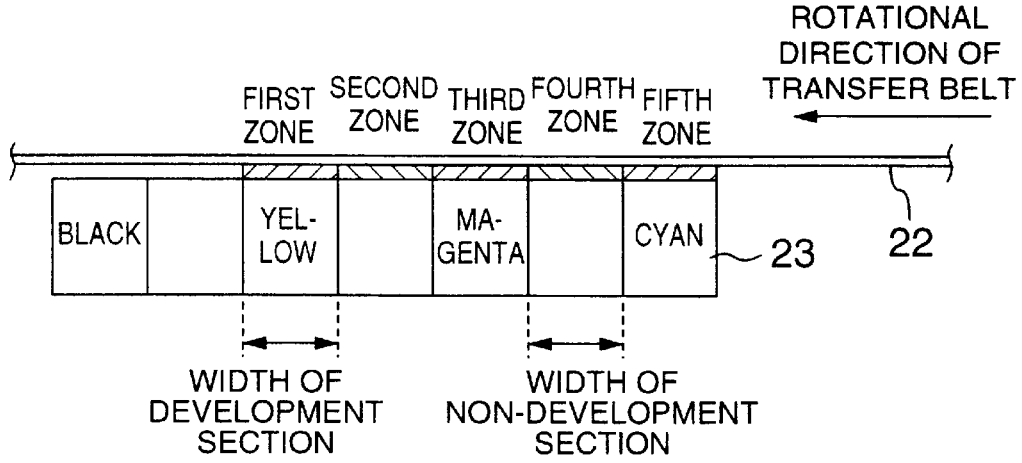
FIG. 10 is a typical schematic view illustrating a state of an image transfer in the image display unit according to the first embodiment of the present invention.

Next, as shown in FIG. 10, in the fifth transfer, the toner images of {cyan, magenta and yellow} are transferred in one producing step so that the superimposed toner images of {cyan, magenta and yellow} are formed on the first zone, the superimposed toner images of {cyan and magenta} are formed on the third zone and only the toner image of {cyan} is transferred to the fifth zone. When the transfer belt 22 is rotatably moved by a length corresponding to the width of the development zone, the sixth transfer is carried out in such a manner that the toner images of {cyan, magenta and yellow} are likewise transferred in one producing step so that the superimposed toner images of {cyan, magenta and yellow} are formed on the second zone, and the superimposed toner images of {cyan and magenta} are formed on the fourth zone and only the toner image of {cyan} is transferred to the sixth zone.

Figure 11:
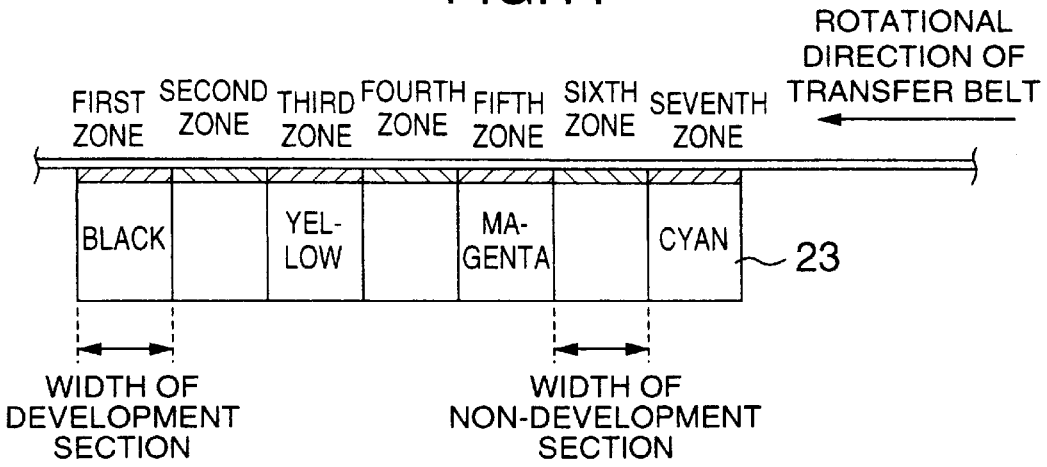
FIG. 11 is a typical schematic view illustrating a state of an image transfer in the image display unit according to the first embodiment of the present invention.

After that, as shown in FIG. 11, in the seventh transfer, the toner images of {cyan, magenta, yellow and black} are transferred in one producing step so that the color toner image of {cyan, magenta, yellow and black} is formed on the first zone, the superimposed toner images of {cyan, magenta and yellow} are formed on the third zone, the superimposed toner images of {cyan and magenta} are formed on the fifth zone and only the toner image of {cyan} is transferred to the seventh zone.

In the latter of the transfer steps, the reverse steps are taken, namely, a cyan is dispensed with in the above step that the toner images of {cyan, magenta, yellow and black} are formed in one producing step, and then it is changed into the toner images of {magenta, yellow and black}, and further a magenta is also removed so that it is changed into the toner images of {yellow and black}, and finally only the toner image of {back} is used.

After the above steps are repeated, as illustrated in FIG. 1, a portion of the transfer belt 22 on which the image is completely formed becomes gradually apart from the toner image carrier 23. As shown in FIG. 3, when the transfer belt 22 on which the whole image is formed has been apart from the toner image carrier 23, the rotation of the transfer belt 22 is stopped and the resulting complete image is displayed.

Embodiment 2

Explaining the outline of the second embodiment of the present invention, since it is known that toner particles opaque in the normal state are turned to be transparent when melted by heating, the image display unit for a color system described in the above Embodiment 1 is provided with a fixing means capable of melting toner particles, the transfer belt is made of a transparent material, and a back light is disposed behind the transfer belt for illuminating the colored toner image to show up clearly with the aid of the transmitted light. Specifically, referring to colors of substances, there are two kinds of colors each generated by a reflected light and transmitted light, and the color by a transmitted light is more brilliant than that by a reflected light, accordingly such a measure is employed that the colored toner image on the transfer belt is able to be seen using a transmitted light.

Hereinafter, referring to FIGS. 12 and 13, the second embodiment of the present invention is explained in detail, however, the specification of the toner image formation unit is the same as that of the embodiment 1 so that the second explanation therefor is omitted and the related part of the embodiment 1 is only quoted. Also, because a formation of the colored toner image on the transfer belt is the same as what is described in the embodiment 1 referring to FIGS. 8 to 11, the explanation is omitted and it is first explained how to treat the colored toner image on the transfer belt.

Figure 12:
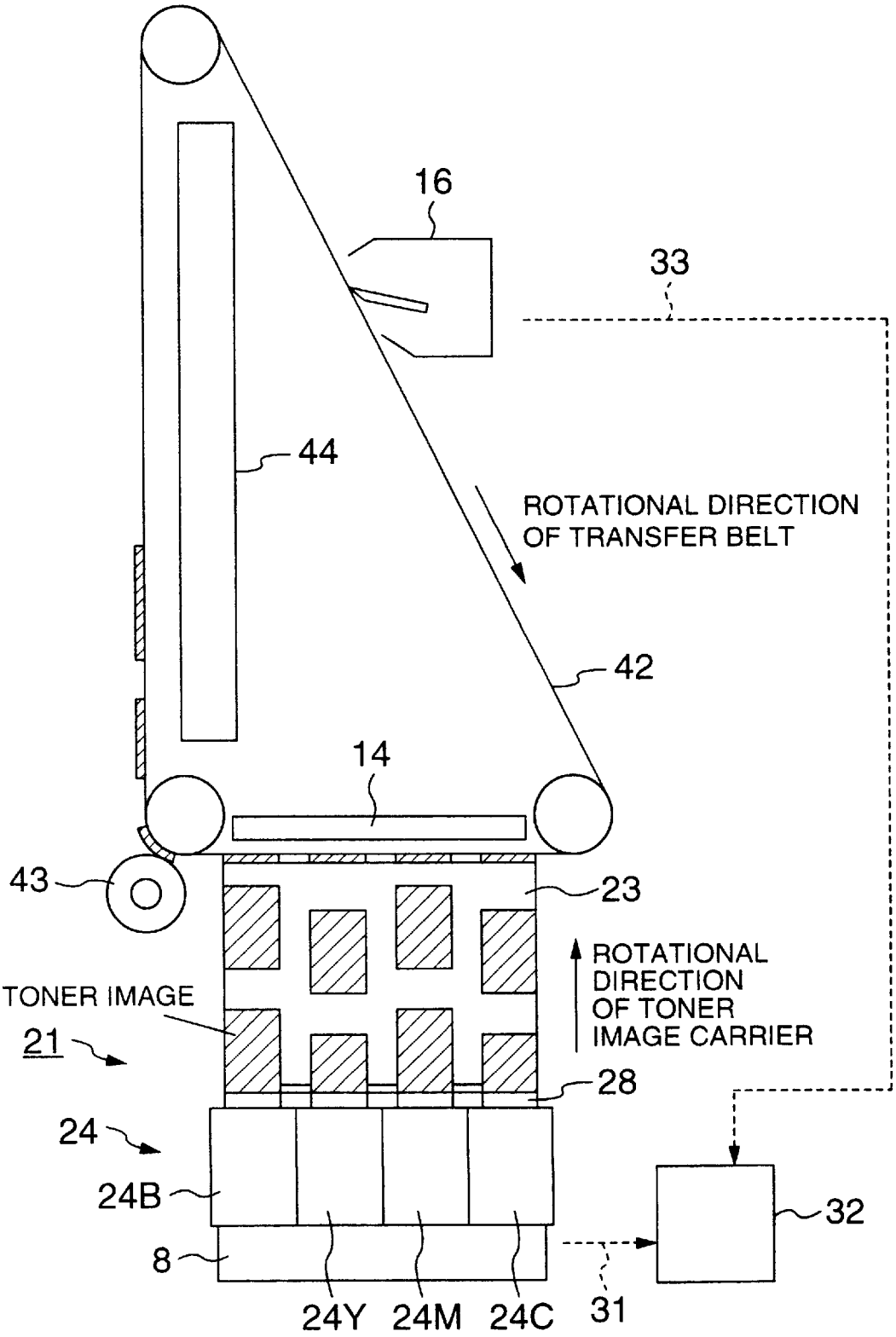
FIG. 12 is a schematic side view illustrating an image display unit according to a second embodiment of the present invention.
Figure 13:
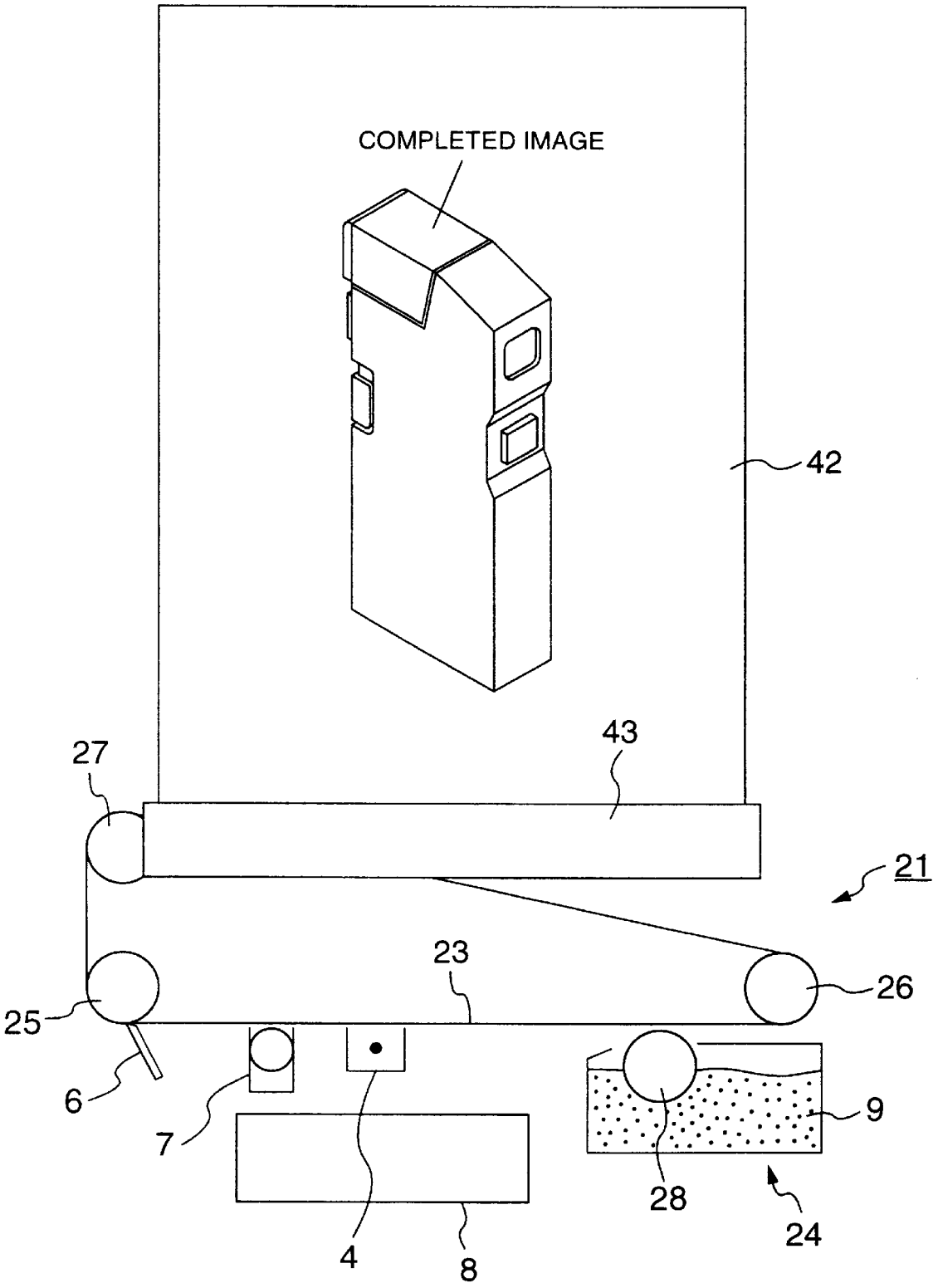
FIG. 13 is a schematic front view illustrating a state of an image display in the image display unit according to the second embodiment of the present invention.
Figure 14:
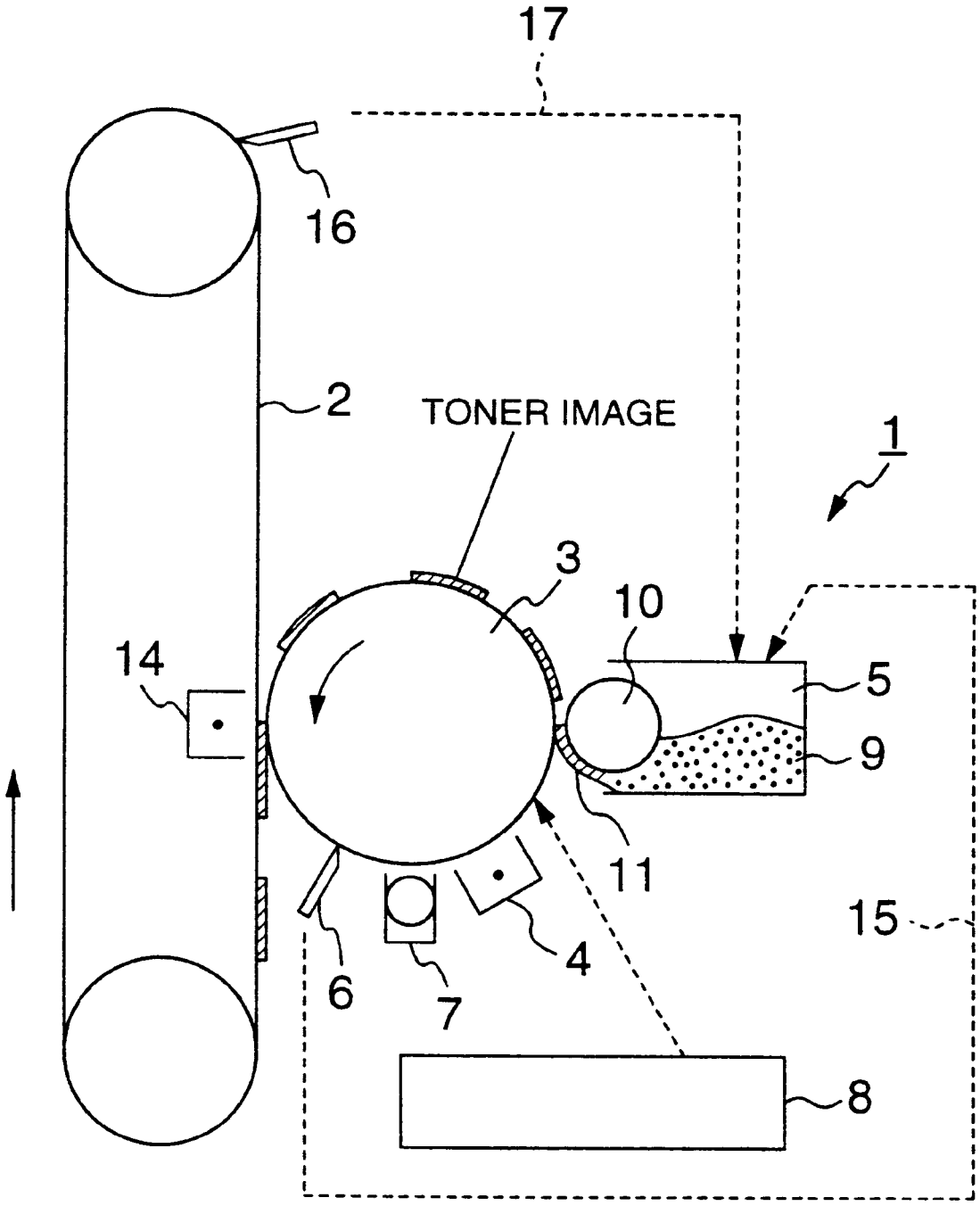
FIG.14 PRIOR ART
FIG. 14 is a schematic side view illustrating a conventional image display unit.
Figure 15:
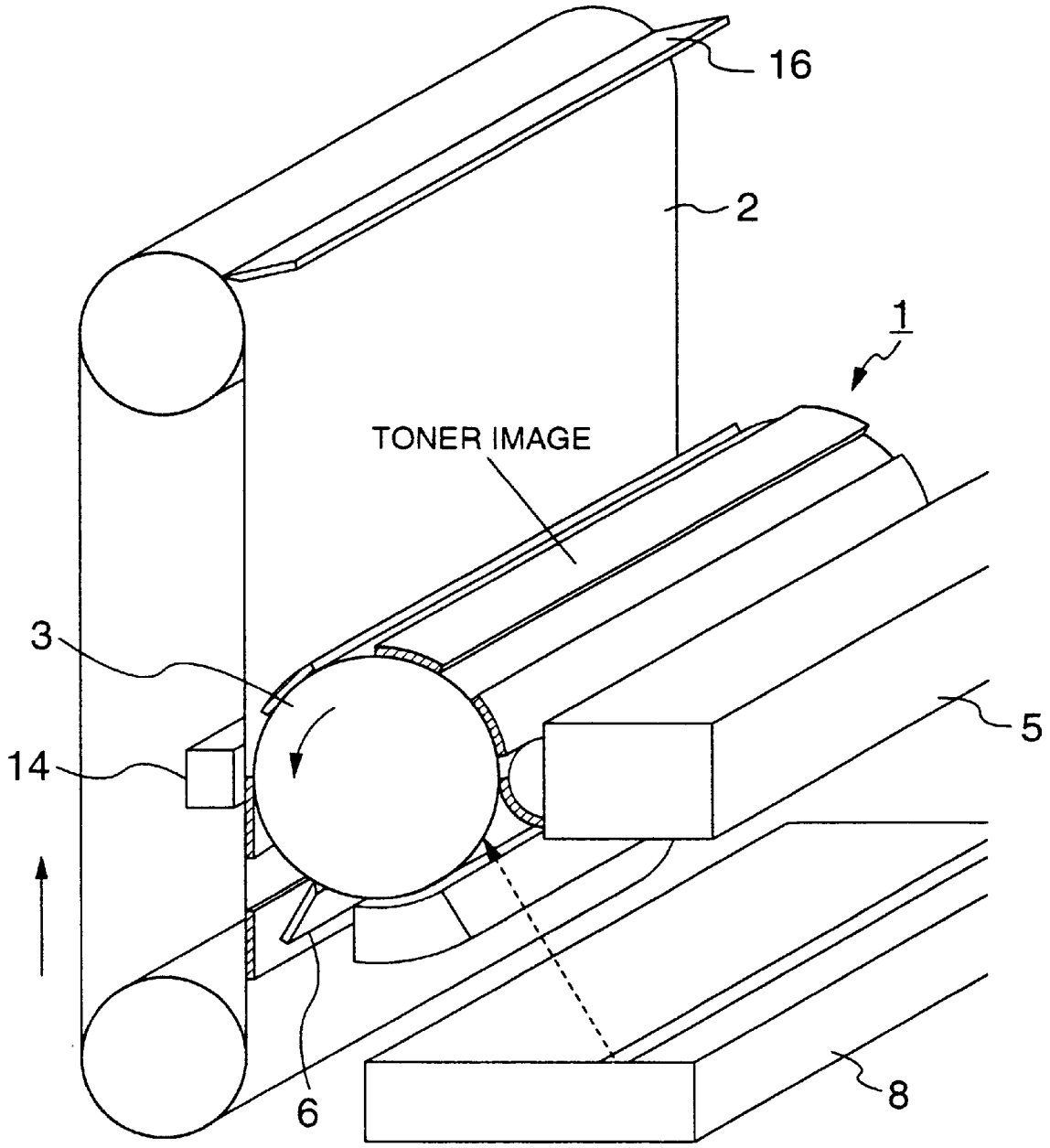
FIG.15 PRIOR ART
FIG. 15 is a perspective view illustrating image transfer steps in the conventional image display unit.
Figure 16:
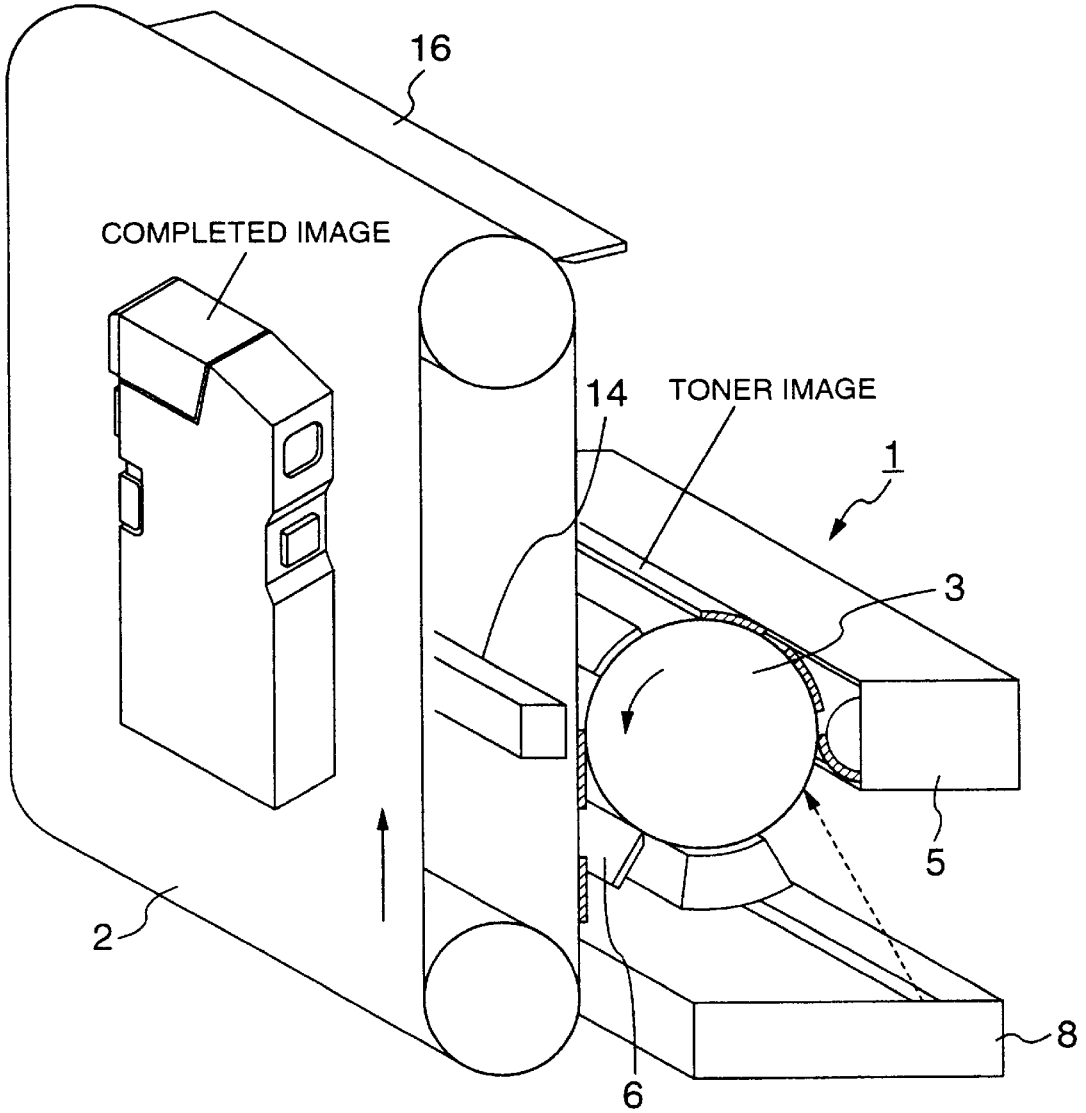
PRIOR ART FIG.16
FIG. 16 is a perspective view illustrating a state of an image display in the conventional image display unit.
Figure 17:
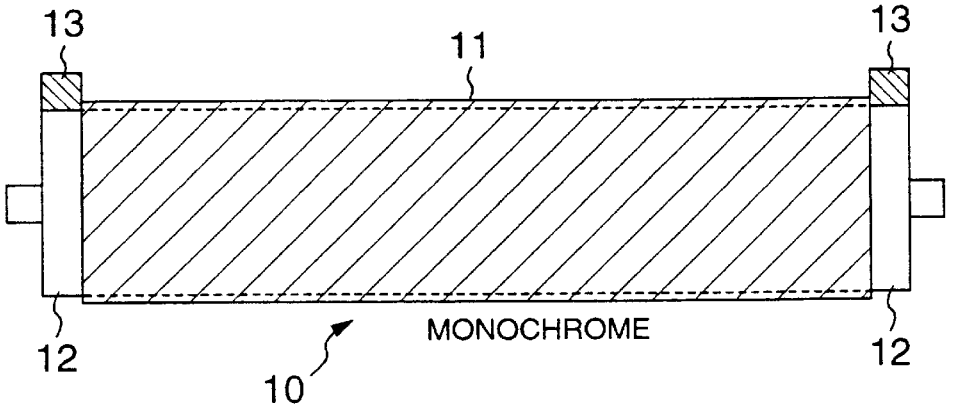
FIG.17 PRIOR ART
FIG. 17 is a typical schematic view illustrating a formation of a toner layer by a developing roller in the conventional image display unit.

FIG. 12 is a schematic side view showing an image display unit according to the second embodiment of the present invention, and FIG. 13 is a schematic side view showing a state of a image display caused by an image display unit according to the second embodiment of the present invention.

Referring to FIGS. 12 and 13, the outline of the image display unit is explained, the constitution of the image display unit comprises generally a toner image formation unit 21 for forming a toner image, a transfer belt 42 for serving as a display board, a fixing means for temporarily fixing a colored toner image on the transfer belt 42, and a back light for illuminating the transfer belt 42 from behind the transfer belt 42 being transparent. This image display unit is obtained by employing a constitution wherein the image display unit for a color system as explained in the embodiment 1 is provided with the fixing means 43 and thereby the colored toner image on the transfer belt 42 is fixed thereto.

In FIGS. 12 and 13, the transfer belt 42 is made of a photosensitive material and is formed of a transparent material capable of transmitting a light beam. The colored toner image just formed on the transfer belt 42 by being transferred from the toner image carrier 23 is merely an aggregation itself of the toner 9 of the mixture of the four primary color toners, in this state the toner 9 is opaque so that the color of the colored toner image is caused by a reflected light beam. The toner particles are not transparent while encapsuled, however, when the capsules are melted by heating, the physical properties are changed so that the capsules become transparent. Consequently, the colored toner image on the transfer belt 42 is made transparent by putting it through the fixing means for heating thereof and thus melting the capsules, however, the colored toner image is fixed to the transfer belt 42 in the above step of passing through the fixing means 42. In the transfer step, it is unnecessary to fix the toner image to the transfer belt 42, and it is sufficient to melt only the toner image on the transfer belt 42, so the image is fixed preferably to the transfer belt 42 as slightly as possible. Hence, the surface of the transfer belt 42 is coated with fluororesin to thereby weaken the fixing power of the colored toner image (its peelablity is improved). The fluororesin as referred to herein is to mean a fluorine compound having a low coefficient of friction such as tetrafluoroethylene resin etc.

The colored toner image transparentized by passing through the fixing means 43 is gradually conveyed toward the surface of the image display unit, a potion of the transfer belt 42 on which the image is formed gets apart from the toner image carrier 23. When the whole of the portion having the image formed thereon has been parted from the toner image carrier 23, the rotation of the transfer belt 42 is stopped, and the completed colored image is displayed more brightly by receiving a light beam radiated from a back light 44. Conveniently the back light 44 is disposed behind the transfer belt 42, however, the position thereof is allowed to be in the backside of the side of the transfer belt 42 as far as the transmitted light is radiated from behind the transfer belt 42.

When it is ended to display an image on the transfer belt 42, there is erased the whole image on the transfer belt 42 (the image can be taken as a residual toner material just when the display is ended) so as to prepare for the following image transfer. For this purpose, the whole image on the transfer belt 42 is removed and recovered by means of a cleaning blade or cleaning brush of the cleaning means 16 used exclusively for the transfer belt 42 to thus clean physically the surface of the toner image carrier 23. Usually it is difficult to clean the fixed image. However, since the surface of the transfer belt 42 is coated with fluororesin, the image is easily separated so that the cleaning proceeds without any difficulty. The residual toner recovered from the transfer belt 42 is conveyed toward the waste toner box 32 by a toner conveying means 33 using an auger etc. (as denoted by an arrow of the dotted line in FIG. 12) and contained therein together with the other residual toner recovered from the toner image carrier 23. As described above, a successive flow of the image formation steps is completed.

The sensitive material is not necessarily used for the toner image carrier, and under a certain circumstance the exposing means is dispensed with. This is because a toner image can be provided by forming an electrostatic latent image by use of a heat source followed by developing it, or by blowing off a toner image solidly coated with toner by an air jet means as if a woodcut print was cut.

As mentioned above, according to the present invention, an image display unit of the present invention comprises a transfer belt of an endless type being tensioned by a plurality of rollers, a toner image carrier of an endless type being tensioned in the direction orthogonal to the rotational direction of the transfer belt, an image formation means for providing the toner image carrier with a toner image, and a transfer handling roller disposed inside the toner image carrier for transferring the toner image held on the toner image carrier to the transfer belt by being rotated in the direction orthogonal to the rotational direction of the transfer belt, wherein the toner image carrier is rotated in the direction orthogonal to the rotational direction of the transfer belt so that the width of the toner image carrier is not restricted by that of the transfer belt. In addition, because the former is enabled to be smaller than the latter, the present invention has an advantage to miniaturize an image display unit sharply.

What is claimed is:

1. An image display unit, comprising: a transfer belt of an endless type being tensioned by a plurality of rollers; a toner image carrier of an endless type being tensioned in a direction orthogonal to a rotational direction of the transfer belt; an image formation means for providing the toner image carrier with a toner image; and a transfer handling roller disposed inside the toner image carrier for transferring the toner image held on the toner image carrier to the transfer belt by being rotated in the direction orthogonal to the rotational direction of the transfer belt.

2. An image display unit according to claim 1, wherein the toner image carrier and the image formation means are each disposed over the transfer belt.

3. An image display unit according to claim 1, wherein the toner image carrier and the image formation means are each disposed under the transfer belt.

4. An image display unit according to claim 1, wherein the toner image carrier comprises a photosensitive belt, and the image formation means comprises an exposing means for expose the toner image carrier based upon an image signal and a developing means for developing the toner image carrier using the toner.

5. An image display unit according to claim 4, wherein the developing means conducts the development using at least three primary colors of cyan, magenta and yellow.

6. An image display unit according to claim 5, wherein the image display unit further comprises a fixing means for fixing the toner image transferred on the transfer belt thermally.

7. An image display unit according to claim 6, wherein a surface of the transfer belt is coated with fluororesin.

8. An image display unit according to claim 6, wherein the transfer belt is formed of a transparent material, and a back light is disposed behind the transfer belt.

9. An image display unit, comprising: a transfer belt of an endless type being tensioned by a plurality of rollers; a toner image carrier of an endless type being tensioned in a direction orthogonal to a rotational direction of the transfer belt; an image formation means for providing the toner image carrier with a toner image; and a transfer handling roller disposed inside the toner image carrier for transferring the toner image held on the toner image carrier to the transfer belt by being rotated in the direction orthogonal to the rotational direction of the transfer belt, wherein the toner image transferred on the transfer belt is displayed.

10. An image display unit, comprising: a transfer belt of an endless type being tensioned by a plurality of rollers; a toner image carrier of an endless type being tensioned in a direction orthogonal to a rotational direction of the transfer belt; an image formation means for providing the toner image carrier with a toner image; a transfer handling roller disposed inside the toner image carrier for transferring the toner image held on the toner image carrier to the transfer belt by being rotated in the direction orthogonal to the rotational direction of the transfer belt; and a cleaning means for cleaning the toner image transferred on the transfer belt.

11. An image display unit according to claim 10, wherein the toner image carrier comprises a photosensitive belt, the image formation means comprises an exposing means for exposing the toner image carrier based upon an image signal, and a developing means for developing the toner image carrier using the toner, the developing means conducts a development using only a monochromatic toner, and the toner recovered by cleaning of the cleaning means is conveyed to the developing means.

12. An image display unit, comprising: a transfer belt of an endless type being tensioned by a plurality of rollers; a toner image carrier of an endless type being tensioned in a direction orthogonal to a rotational direction of the transfer belt; an image formation means for providing the toner image carrier with a toner image; a transfer handling roller disposed inside the toner image carrier for transferring the toner image held on the toner image carrier to the transfer belt by being rotated in the direction orthogonal to the rotational direction of the transfer belt; the toner image transferred on the transfer belt being able to be displayed; and a cleaning means for cleaning the toner image already displayed.

* * * * *